US010316544B2

(12) United States Patent
Mitchell

(10) Patent No.: US 10,316,544 B2
(45) Date of Patent: Jun. 11, 2019

(54) RETURN CARTRIDGE FOR DOOR HANDLES

(71) Applicant: Endura Products, Inc., Colfax, NC (US)

(72) Inventor: Mike Mitchell, Winston-Salem, NC (US)

(73) Assignee: Endura Products, Inc., Colfax, NC (US)

( * ) Notice: Subject to any disclaimer, the term of this patent is extended or adjusted under 35 U.S.C. 154(b) by 906 days.

(21) Appl. No.: 14/879,379

(22) Filed: Oct. 9, 2015

(65) Prior Publication Data

US 2017/0101805 A1 Apr. 13, 2017

(51) Int. Cl.

| | |
|---|---|
| ***E05B 13/00*** | (2006.01) |
| ***E05B 15/02*** | (2006.01) |
| ***E05B 3/06*** | (2006.01) |
| ***E05B 63/04*** | (2006.01) |

(52) U.S. Cl.

CPC ..... *E05B 3/065* (2013.01); *E05B 13/002* (2013.01); *E05B 15/02* (2013.01); *E05B 63/04* (2013.01)

(58) Field of Classification Search

CPC ..... E05B 3/065; E05B 63/04; E05B 13/002; E05B 15/02

See application file for complete search history.

(56) References Cited

U.S. PATENT DOCUMENTS

| | | | | |
|---|---|---|---|---|
| 5,636,882 | A * | 6/1997 | Hook | E05B 3/065 292/169.15 |
| 5,727,824 | A | 3/1998 | Smith et al. | |
| 7,152,891 | B2 | 12/2006 | Bergen et al. | |
| 7,261,341 | B2 | 8/2007 | Fan | |
| 7,748,758 | B2 | 7/2010 | Fang et al. | |
| 8,360,489 | B2 | 1/2013 | Cho | |
| 8,746,760 | B2 | 6/2014 | Chen et al. | |
| 2006/0049644 | A1 | 3/2006 | Bergen et al. | |
| 2007/0182169 | A1 | 8/2007 | Fang et al. | |
| 2013/0229021 | A1* | 9/2013 | Wang | E05B 55/005 292/336.3 |

(Continued)

FOREIGN PATENT DOCUMENTS

FR 2650322 A1 2/1991

OTHER PUBLICATIONS

Canadian Office Action for App. No. 2938525, dated Jul. 11, 2017, 6 pgs.

(Continued)

*Primary Examiner* — Kristina R Fulton
*Assistant Examiner* — Thomas L Neubauer
(74) *Attorney, Agent, or Firm* — Womble Bond Dickinson (US) LLP

(57) ABSTRACT

A handle return assembly removably attachable to an escutcheon. The removably attachable assembly may include a housing to be attached to the escutcheon and a hub rotatably disposed within the housing for operably connecting an operating handle to a drive spindle. A torsion spring may bias the hub toward an initial position. At least one stopper plate may interact with the cartridge housing for limiting rotational motion of the hub relative to the housing. Selectively positioning the stopper plate and the spring relative to the housing provides the assembly with the ability to provide a right-handed operation and a left-handed operation.

17 Claims, 10 Drawing Sheets

(56) References Cited

U.S. PATENT DOCUMENTS

| | | | | |
|---|---|---|---|---|
| 2014/0007631 | A1* | 1/2014 | Wood | E05B 63/08 70/357 |
| 2015/0107314 | A1* | 4/2015 | Le | E05B 1/003 70/209 |
| 2016/0017634 | A1* | 1/2016 | Parker | E05B 17/0058 292/336.3 |

OTHER PUBLICATIONS

Rocky Mountain door hardware, known at least as early as Mar. 31, 2015, 1 pg.
Emtek door hardware, known at least as early as Mar. 31, 2015, 1 pg.
Truth Hardware, Sentry Hinged Patio Door Handle Set, Semi-Active Assembly, Installation Instructions, known at least as early as Jun. 16, 2015, 1 pg.

* cited by examiner

RETURN CARTRIDGE FOR DOOR HANDLES

FIELD OF DISCLOSURE

The present disclosure relates to the operation of door handles and corresponding locking and latching components. More particularly, the present disclosure relates to door components that bias the position and rotation of door handles.

BACKGROUND

Door handles are present on nearly every door in a home. Typically these handles rotate to retract a latch and allow the door to be swung open. Then, in almost every case, the handle automatically returns to its original home position with the latch extending from the door stile once again. Handle return components can be prone to wear after repeated use over time. As these components wear, the force available to return the handle to the home position weakens. In some cases, where the handle is a lever, the weight of the lever causes a torque around the axis of rotation and may eventually lead to the handle sagging, i.e. resting below an intended home position.

Some handles are biased to a home position by features incorporated into the case of a mortise lock. These embodiments may require replacement of an entire lock if the lever return mechanism becomes worn. In other existing embodiments, biasing features are integrated with escutcheons on either side of the door. Escutcheons, however, are often uniquely configured for placement on either an interior or exterior side of door. As a result, the handing of the door must be known in order to acquire the proper set of escutcheons with integrated biasing features.

There is a need for a handle return design that allows for improvements associated with the installation or replacement of these elements eliminating the need for prior knowledge of a door's handing.

SUMMARY

The present disclosure describes a handle return assembly removably attachable to an escutcheon. The removable assembly may include a housing to be attached to the escutcheon and a hub rotatably disposed within the housing for operably connecting an operating handle to a drive spindle. A spring may bias the hub toward an initial, home position. At least one stopper plate may interact with the housing for limiting rotational motion of the hub relative to the housing.

Other embodiments include a handle return assembly separate from but removably attachable to an escutcheon. The handle return assembly is configured to interact with a handle such that the handle is biased to an initial home position and the handle is rotatable relative to the escutcheon about a predetermined sweep angle in a single direction relative to the home position to define a left-handed or right-handed operation. The assembly can be disassembled and reassembled using the same parts to change the operation of the assembly among left-handed, right-handed and a non-operating configuration where rotation in neither direction is permitted.

Other embodiments include a door hardware kit having an exterior escutcheon, an interior escutcheon, a first handle return cartridge configured to provide left-handed operation, and a second handle return cartridge configured to provide right-handed operation. Each handle return cartridge may be capable of being attached to either escutcheon such that the elements of the kit may be selectively assembled to operate a left-hand or a right-hand door.

These and other features of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

The foregoing and still other objects and advantages of the present invention will be more apparent from the following detailed explanation of embodiments of the invention in connection with the accompanying drawings.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

In practice today, handles can be biased to a home position by features incorporated into the case of a mortise lock. As used herein, the terms initial position and home position may be used interchangeably to describe the position of components under the biasing force of return features without added external forces, e.g. forces applied by a user. When these biasing features wear out, the entire lock mechanism must be replaced. In other existing embodiments, biasing features are integrated with escutcheons on either side of the door. Escutcheons, however, are often uniquely configured for placement on either an interior or exterior side of the door. As a result, the handing of the door must be known in order to acquire the proper set of escutcheons with integrated biasing features. As is known in the art, door handing may be determined based on facing the exterior of the door, determining whether the hinge for the door is on the right or the left, and determining whether the door will swing open toward the interior or the exterior. The handing of the door may affect the hardware so that the desired rotation of the handles results in the proper motion of the lock.

Embodiments of the present disclosure improve upon these existing designs by having handle return modules, also referred to as handle return assemblies or handle return cartridges, that may be removably attached to the preferred escutcheon. As a result, the handle return modules may be independently replaced if they become worn. Further, installation of a door hardware kit having the described handle return modules will not require predetermined knowledge of the handing of the door, potentially providing a benefit to the installer, and potentially providing a benefit, by way of inventory control, for the manufacturer.

Figure 1:
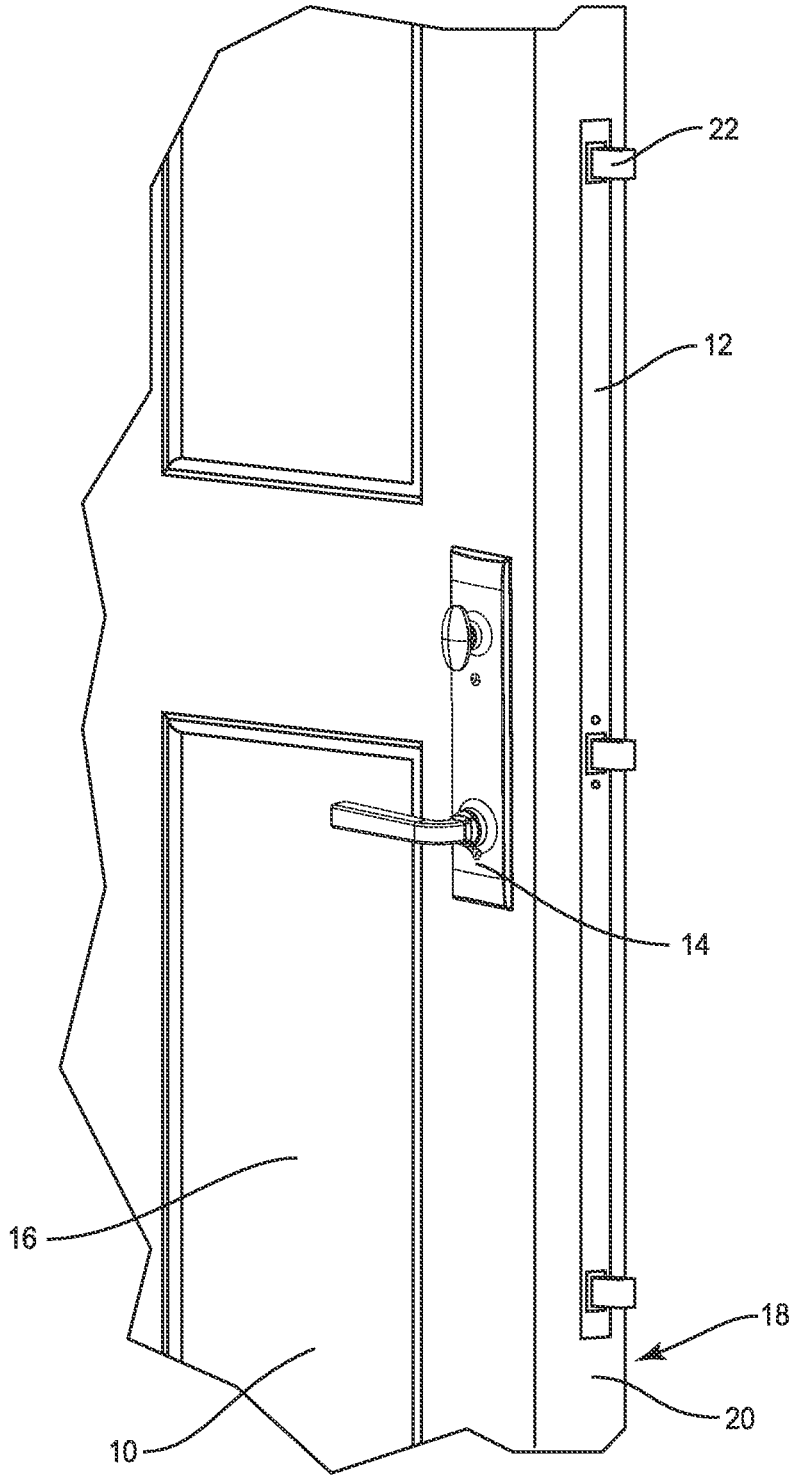
FIG. 1 is a perspective view of a door having a kit according to embodiments of the present disclosure install thereon.

FIG. 1 is an interior perspective view of a door 10 having right-hand operation in a slightly open position. As is known in the art, right-hand operation occurs when, facing an exterior of the door, the hinge is on the right and the door swings inward. Inswing entryway doors are commonly found in residential settings. The door 10 is generally provided with a lock 12, such as a mortise lock, and door hardware 14 provided on the door 10 to interact with and operate the lock 12.

The door 10 may be described in terms of an interior side 16 and an opposite exterior side 18. A stile 20 extends along the edge of the door 10 between the interior side 16 and the exterior side 18. The stile 20 may be provided with a cavity or mortise to accommodate one or more portions of the lock 12. The type of lock 12 is not particularly limited for the purposes of this disclosure. Features and advantages of this disclosure, however, may be particularly applicable to multi-point mortise locks that have several spaced apart latches 22 extending and retracting relative to a stile 20, all driven in response to input through the door hardware 14.

Figure 2:
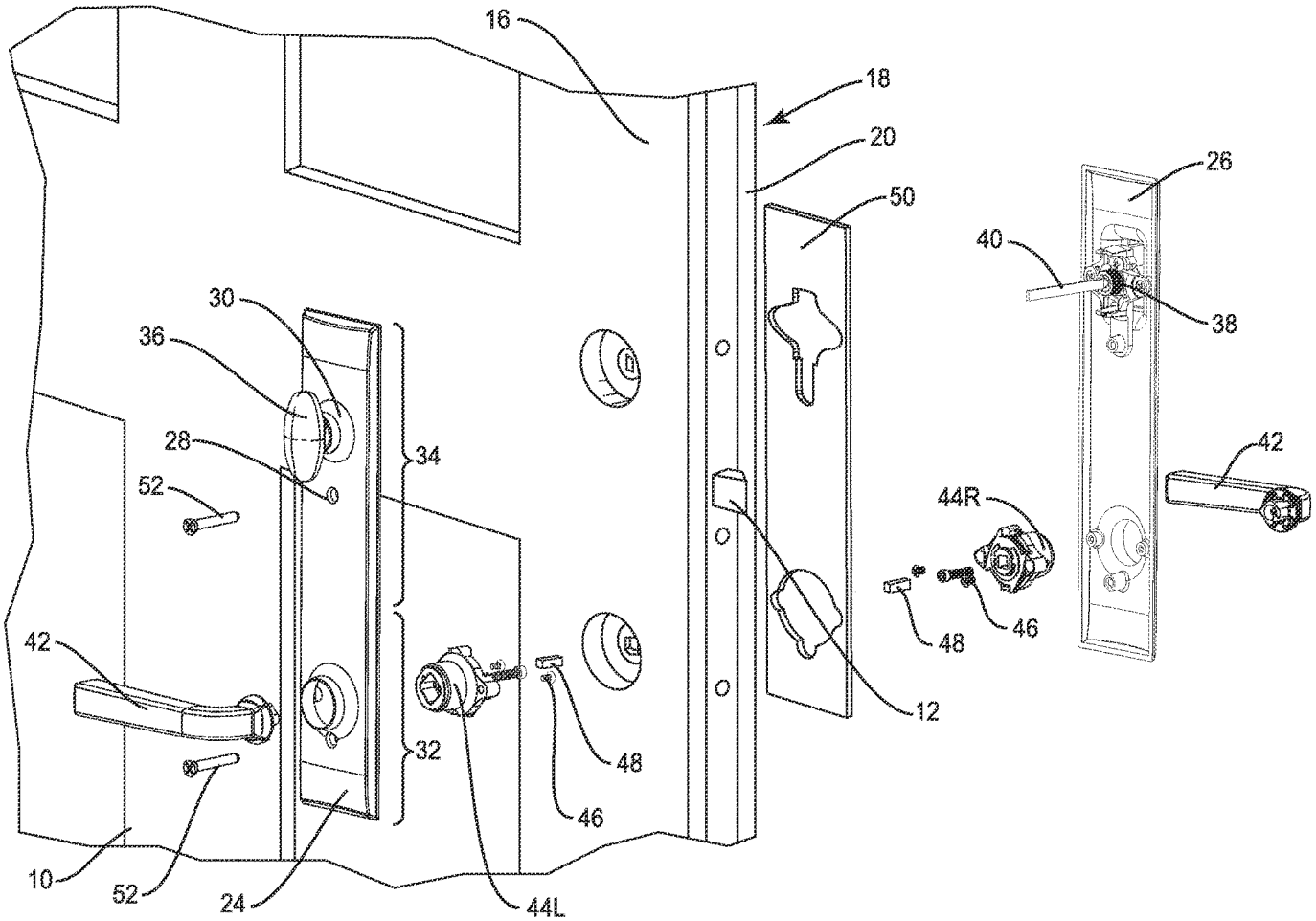
FIG. 2 is an exploded view of the installed kit from FIG. 1.

FIG. 2 is an exploded view of the door 10 from FIG. 1. Elements of the door hardware will now be described in more detail. Some or all of the components of the door hardware may be provided in the form of a kit of unassembled or partially assembled parts that may be assembled upon the door 10 to operate the lock 12 as well as potentially provide other security and sealing functions.

The door hardware 14 (FIG. 1) may include an interior escutcheon 24, and an exterior escutcheon 26. In some embodiments the interior and exterior escutcheons 24, 26 may be substantially similar. In other embodiments, the interior and exterior escutcheons 24, 26 may have one or more unique features. In one example, the interior escutcheon 24 may have mounting apertures 28 that are not visible on the exterior escutcheon 26. In other example, the shape of a collar 30 may be different on each of the escutcheons 24, 26. In the illustrated embodiment, the escutcheons 24, 26 each have a latch region 32 and a deadbolt region 34. The deadbolt region 34 is optional.

Where present, the deadbolt region 34 may correspond with additional optional components for the operation of a deadbolt feature within the lock 12. For example, FIG. 2 shows the interior escutcheon 24 assembled with a thumbturn 36. When fully assembled the thumbturn 36 may operate a key cylinder 38 shown installed on the exterior escutcheon 26. The key cylinder 38 may be provided separate from or preassembled with the exterior escutcheon 26. The key cylinder 38 may be provided along with one or more keys (not shown), one or more drive rods 40, and any fasteners necessary to combine the key cylinder 38 to the exterior escutcheon 26.

Continuing with FIG. 2, the kit of door hardware may also include a set of two door handles 42, one for the interior side 16 of the door 10 and one for the exterior side 18 of the door 10. The configuration of each handle 42 is not particularly limited. To provide a mechanical advantage when operating a multi-point lock, however, lever style handles as shown may be used.

The door hardware also includes at least one handle return module 44. The handle return module may also be referred to interchangeably as a handle return assembly, unit or cartridge. Each handle return module 44 is configured to separate from the escutcheons, for example being removably coupled to an escutcheon by one or more fasteners 46. In most embodiments, the door hardware 14 (FIG. 1) includes a right-handed handle return module 44R and a left-handed handle return module 44L. In the illustrated embodiment, door 10 is right-handed. Therefore the right-handed handle return module 44R corresponds with the exterior escutcheon 26 and the left-handed handle return module 44L corresponds with the interior escutcheon 24. When assembled with their respective handles 42, each handle return module is configured to provide a biasing force that is designed to return each handle 42 to an initial, home position. In the case of lever type handles, the home position is generally understood as a horizontal position of the lever, where the handle is operated by rotating the handle downward.

The door hardware 14 (FIG. 1) may include other features and elements provided to facilitate assembly and use of the components discussed above. One or more spindles 48 may be used to transfer motion from the handles 42 or the handle return modules 44 to the lock 12. Additional elements may include one or more escutcheon gaskets 50 for sealing an escutcheon 24, 26 to a respective side of the door 10. The door hardware may also include mounting screws 52 to attach the escutcheons 24, 26 to the door 10 and other fasteners for assembling the handles 42 onto respective handle return modules 44. A kit having all or some of the door hardware may also include written instructions for the assembly of the door hardware as well as some or all of the tools necessary, e.g. an Allen wrench, for the assembly of the door hardware.

Figure 3:
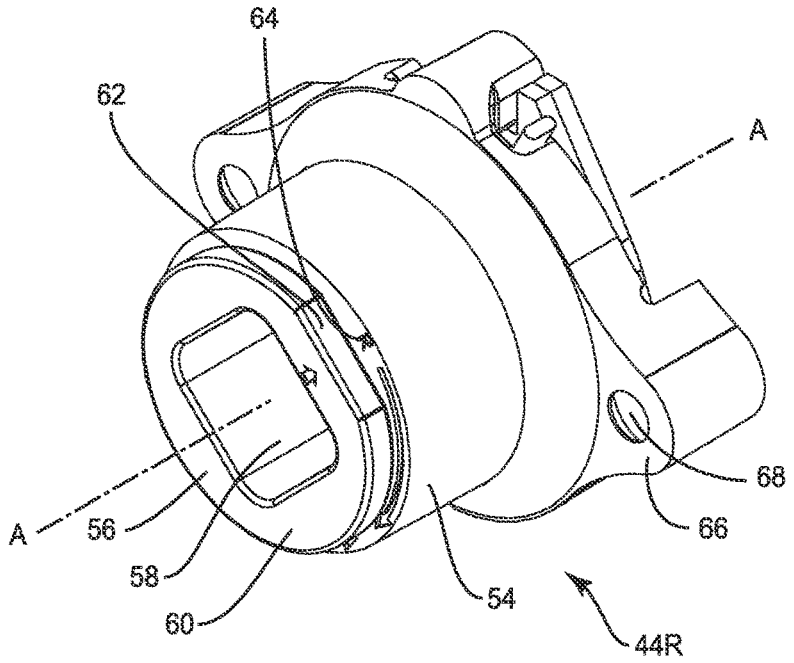
FIG. 3 is a handle-side view of a handle return module.

FIG. 3 shows a handle-side perspective view of the right-handed handle return module 44R in a home position. The home position is the position of the components under the bias force provided by the handle return module 44. As used herein, the handle-side is the side of the handle return module 44 that faces toward a respective handle 42. Opposite the handle-side is the lock-side, the portion of the handle return module 44 that faces toward the lock 12. With this convention, the sides of the handle return modules 44 are fixed without regard to the interior and exterior of the building or whether a handle return module 44 is associated with the interior escutcheon 24 or the exterior escutcheon 26.

Each handle return module 44 may include a housing 54 and a hub 56. The hub 56 may be disposed at least partially within the housing 54. The hub 56 may be generally cylindrical in shape and configured to rotate with respect to the housing 54 about a central rotation axis A. The handle-side of the hub 56 may include a handle-side recess 58 for accepting a portion of a corresponding handle 42. The handle-side recess 58 may be square or polygonal in shape to assist with transferring rotation of a handle 42 around rotation axis A to rotation of the hub 56 within the housing 54. The hub 56 may also include a flange 60 with a keyed portion 62. The keyed portion 62 may be arranged to correspond with an indicia 64 on the housing 54 when the handle return module 44 is in the home position to indicate whether the handle return module 44 has been assembled for right-handed or left-handed operation. Where the indicia 64 is used, a similar marker may be located on the housing 54 at a position rotated 180 degrees around the rotation axis A. When the indicia 64 is provided, the hub 56 may be shifted 180 degrees relative to the rotation axis A into a home position for a left-handed return module. In other embodiments, indication of handing may be provided by other features, such as a label applied during assembly. Where the permanent indicia 64 is not provided, the hub 56 may be similarly positioned relative to the housing 54 in both a right-handed and left-handed assembly.

The housing 54 may include one or more wings 66 projecting in a radial direction from the housing 54 with respect to the rotation axis A. The wings 66 may be provided for locating mounting apertures 68 for use when attaching the handle return module 44 to the appropriate escutcheon 24, 26.

Figure 4:
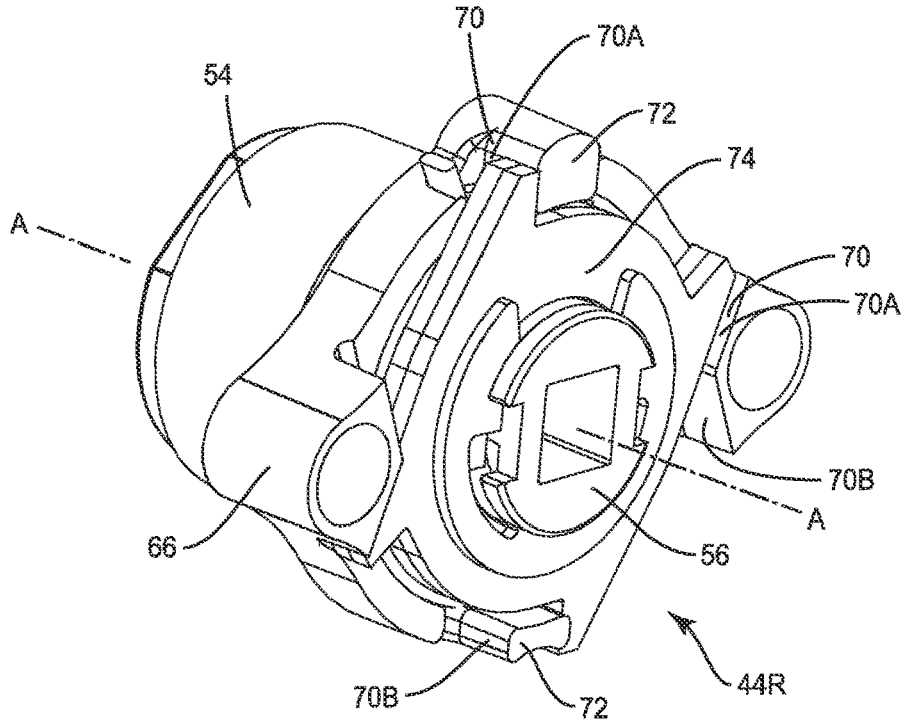
FIG. 4 is a lock-side perspective view of a handle return module assembled for right-handed operation.

FIG. 4 is a lock-side perspective view of a right-handed handle return module 44R in the home position. From the illustrated view, the hub 56 may be forced to rotate counter-clockwise about rotation axis A relative to the housing 54 and would be biased to rotate back to the home position after an outside force were removed. The wings 66 of the housing 54 may provide abutment surfaces 70. The housing 54 may also be provided with additional protrusions 72 that also provide abutment surfaces 70. A first set of abutment surfaces 70A may act to limit rotation at the home position, and a second set of abutment surfaces 70B may act to limit rotation is a direction away from the home position. As will become apparent, depending upon the handing of the handle return module 44, the first and second set of abutment surfaces 70A, 70B may provide stops at the home position and the extended position respectively for one handing and vice versa for the other handing.

The handle return module 44 includes at least one stopper plate 74. In FIG. 4, two stopper plates 74 are shown. The stopper plates 74 are configured to rotate with the hub 56 relative to the housing 54. The stopper plates 74 have a peripheral shape to stop rotation of the hub 56 by contact with the abutment surfaces 70 at both the home and extended positions.

Figure 5:
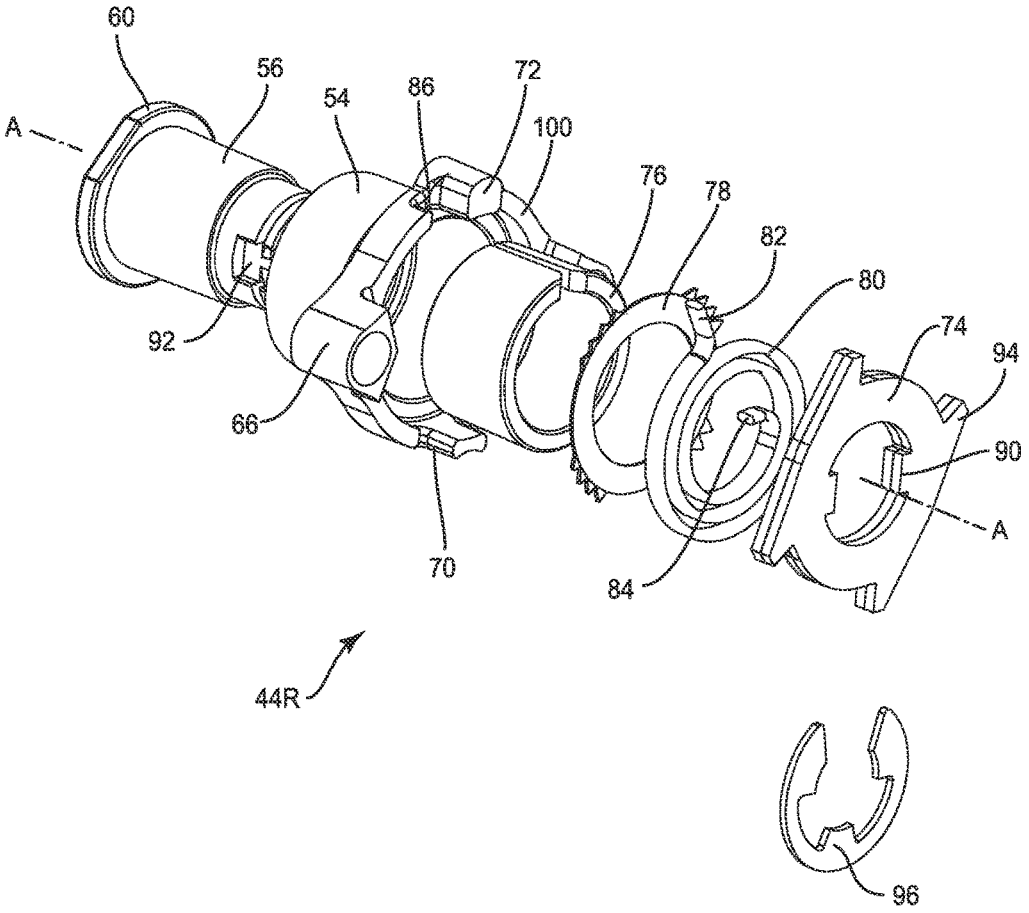
FIG. 5 is an exploded view of the handle return assembly of FIG. 4.
Figure 6:
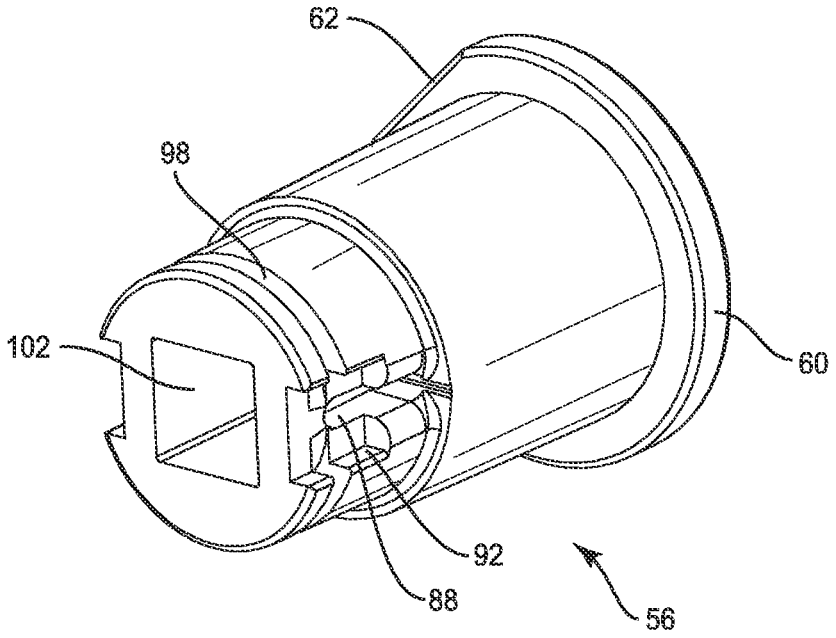
FIG. 6 is a perspective view of a hub according to embodiments of the handle return assembly.

FIG. 5 is an exploded view of the right-handed handle return module 44R. The handle return module includes the housing 54 and the hub 56. A bushing 76 may be provided around the hub 56 and between the hub 56 and an interior of the housing 54 for reducing friction as the hub 56 is configured to rotate within the housing 54. A push washer 78 may be provided around a portion of the hub 56 to help maintain proper alignment of elements along the rotation axis A. A spring 80, such as a torsion spring, may be used to create the return or biasing force for which the handle return module 44 is used. A spiral-type torsion spring is shown in the illustrated embodiment and provides a compact package for use in the handle return module 44. The spring 80 has a radially outer leg 82 and a radially inner leg 84. The radially outer leg 82 may engage a notch 86 in the housing 54. The radially inner leg 84 may engage a slot 88 in the outer surface of the hub 56 as seen in FIG. 6. In some embodiments, a single slot 88 may be provided. In other embodiments, a slot 88 may be provided at two symmetrically opposed locations. From the perspective of FIGS. 4 and 5, as the hub 56 rotates counter-clockwise within the housing 54, the spring 80 stores energy that biases the hub 56 to rotate back in the clock-wise direction after an outside force, e.g. an operator rotating a handle 42, is removed.

As mentioned above, one or more stopper plates 74 are provided to rotate along with the hub 56 and limit rotational motion, such as direction and angular magnitude, relative to the housing 54. Referring to FIG. 5, in one embodiment, the stopper plates 74 have a generally annular shape with a portion of the hub 56 capable of passing through a central opening in each stopper plate 74. The stopper plates 74 may have one or more ribs 90 extending into the central opening and configured to align with an engage one or more channels 92 provided along the hub 56. The rib and channel design shown is only one embodiment. Any mating features provided on the hub 56 and the stopper plates 74 that allow for the stopper plates 74 to rotate with the hub 56 may be sufficient in view of other features discussed below. Suitable mating features may simply include flat portions of the otherwise circular central opening of the stopper plates 74 and corresponding outer periphery of the hub 56.

Referring back to FIG. 4, the stopper plates 74 are also configured to limit rotation of the hub 56 by contact with abutment surfaces 70. As such the stopper plates 74 may include projections 94 extending outwardly from an outer periphery of the stopper plates 74. In one embodiment, the stopper plates 74 have four projections 94. In the home position each of the projections 94 contacts an abutment surface 70 on a respective wing 66 or protrusion 72. In one embodiment, the stopper plates 74 are shaped to be 180 degrees rotationally symmetric about the rotation axis A that passes through the central opening of the stopper plates 74. The rotational symmetry may be apparent from FIG. 7.

With reference to FIG. 5, the parts of the handle return module 44 may be held together by a retaining ring 96 (see FIG. 6) clipping into a retention groove 98 provided near the lock-side of the hub 56. Movement of the components along the rotation axis A relative to the housing 54 may be limited on the handle-side by the flange 60 of the hub 56 and on the lock-side by the retaining ring 96. The stopper plates 74 may be limited in their positioning along the rotation axis A between the retaining ring 96 and a lip 100 of the housing 54. FIG. 6 also shows a lock-side recess 102 configured to accept a portion of the spindle 48 for transferring motion from the hub 56 to the lock 12.

Figure 7:
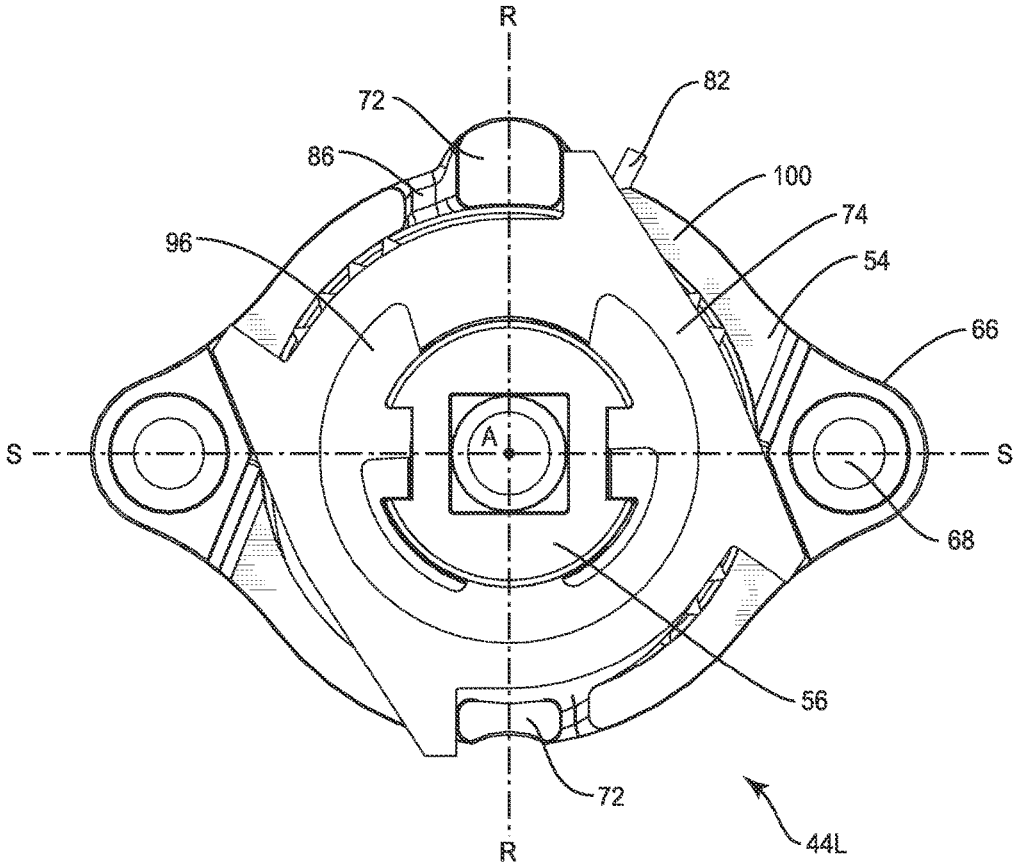
FIG. 7 is a lock-side view of a handle return module assembled for left-handed operation.

FIG. 7 is a lock-side view of a left-handed handle return module 44L in the home position. The left-handed handle return module 44L shown in FIG. 7 is assembled from the same elements used to create the right-handed handle return module 44R shown in FIG. 5 without modifying the construction of any of the individual elements. Comparing the left-handed handle return module 44L with the right-handed handle return module 44R, the spring 80 is flipped, e.g. rotated 180 degrees, about a reversing axis R. In the illustrated embodiment, the reversing axis R is a vertical axis. Though not apparent from FIG. 7, in some embodiments, the hub 56 may rotated 180 degrees about rotation axis A to convert from a right-handed handle return module to a left-handed handle return module in embodiments where only a single slot 88 is present. While rotating the hub 56 may present an extra step, this extra step may still be advantageous because rotating the hub 56 will align the keyed portion 62 with the proper indicia 64. Use of the keyed portion 62 and the indicia 64 may help minimize assembly mistakes.

Further, comparing the right-handed handle return module 44R with the left-handed handle return module 44L, the stopper plates 74 are also flipped. In one example, the stopper plates 74 may be rotated 180 degrees about the reversing axis R. In the embodiment shown, the rotational symmetry of the stopper plates 74 also allows for rotation about a secondary axis S, perpendicular to both reversing axis R and rotation axis A, to achieve the same results of assembling the stopper plates 74 with the housing 54 to change the direction of allowable rotation of the hub 56 relative to the housing 54.

Figure 8:
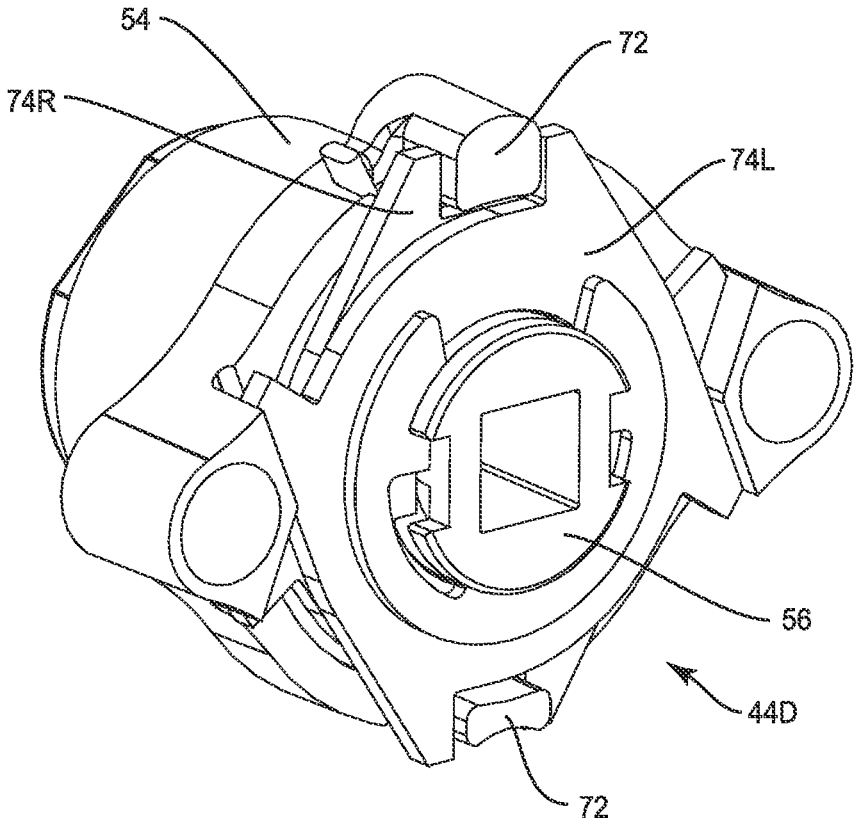
FIG. 8 is a lock-side perspective view of a handle return module assembled for a non-operating application.

FIG. 8 shows another embodiment, a non-operating or dummy handle return module 44D, assembled from the same elements used to create the right-handed handle return module 44R shown in FIG. 5 and the left-handed handle return module 44L shown in FIG. 7 without modifying the construction of any of the individual elements. The dummy handle return module 44D is an embodiment where the hub 56 is substantially prevented from rotation in either direction relative to the housing 54. The dummy handle return module 44D is created by orienting at least a first stopper plate 74R relative to the housing for providing right-handed operation and orientation at least a second stopper plate 74L relative to the housing 54 for providing left-handed operation. The combination of these two oppositely oriented stopper plates 74R, 74L collectively prevent the hub 56 from rotating relative to the housing 54.

The handle return modules 44 of the present disclosure have been designed to use the same components, assembled in different ways, to create a module for right-handed operation, a module for left-handed operation, and a module for dummy operation. The door hardware 14 may include one or more modules in dummy operation when the door hardware is used on an inactive door of a French door pair.

Figure 9:
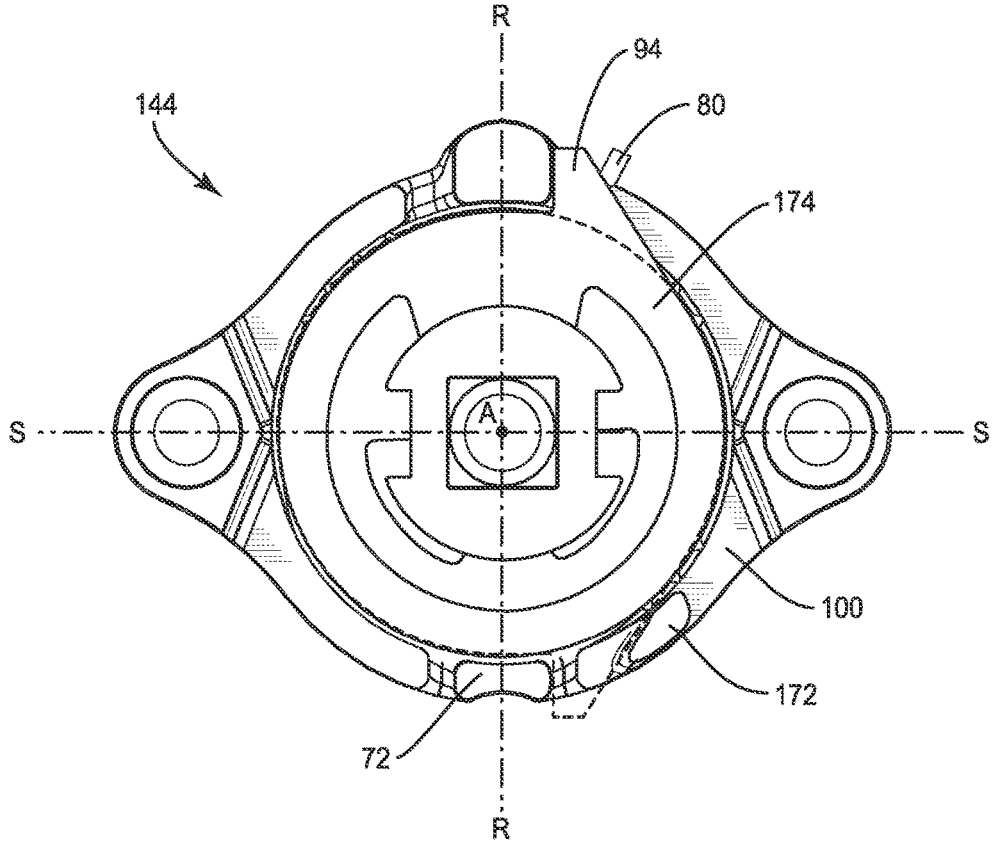
FIG. 9 is a lock-side view of another handle return module.

FIGS. 3-8 present an example embodiment only. FIG. 9 is a lock-side view of a second embodiment of a handle return module 144 assembled for left-handed operation. The stopper plate 174 of this second embodiment includes a single projection 94. To convert the handle return module 144 to right-handed operation, the stopper plate 174 may be flipped about reversion axis R. A spring 80 may also be provided and similarly flipped as discussed above. Further the handle return module 144 of the second embodiment is also capable of a dummy configuration by flipping the stopper plate 174 about secondary axis S, (see dashed lines in FIG. 9) resulting in the projection 94 rotationally constrained between a protrusion 72 similar to one found in the first embodiment, and a boss 172 extending from the lip 100 of the housing 54.

Figure 10:
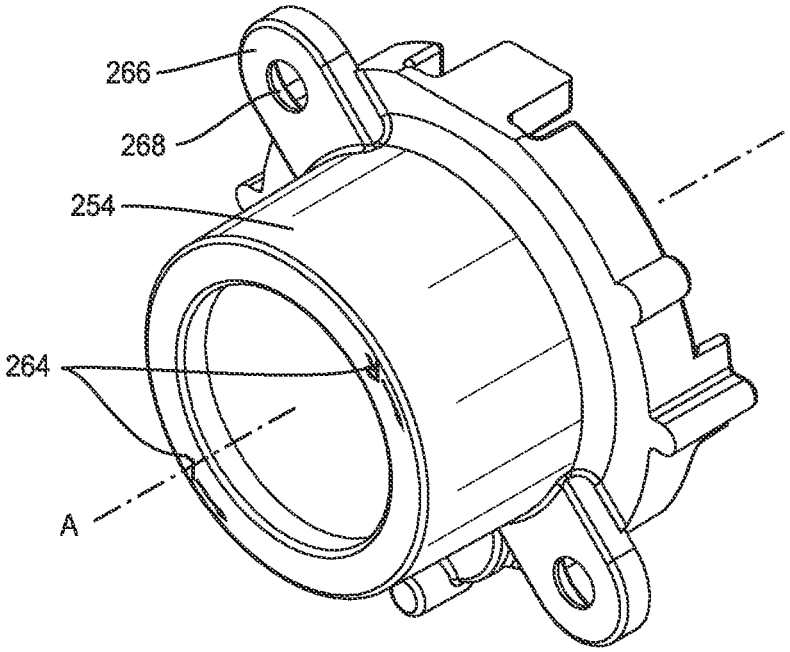
FIG. 10 is a handle-side perspective view of a housing according to another embodiment.
Figure 11:
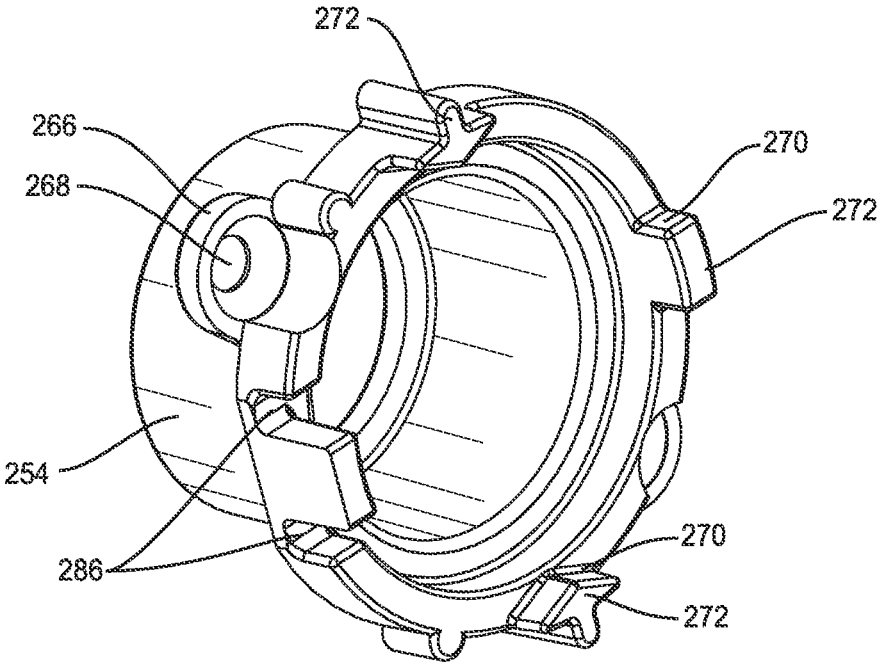
FIG. 11 is a lock-side perspective view of the housing in FIG. 10.

FIGS. 10 and 11 are handle-side and lock-side perspective views of a housing 254 according to another embodiment. The housing 254 may be more narrow along the rotation axis A than the first housing 54, to accommodate alternative escutcheon designs. The housing 254 is designed, however, to be assembled into a handle return assembly 44L. 44R using the remainder of the components shown in FIG. 5, without further modification to components other than between the first housing 54 and the second housing 254.

The housing 254 shown in FIGS. 10 and 11, includes optional indicia 264 to help identify the handing of the finished assembly. The housing 254 also includes one or more wings 266 extending therefrom and having mounting apertures 268 formed in the wings 266 for mounting the housing 254 to an escutcheon. As seen in FIG. 11, the housing 254 also includes a plurality of projections 272 providing a plurality of abutment surfaces 270, similar to those discussed above. The housing 254 also includes a pair of notches 286 to selectively accept the radially outer leg of the spring.

The operation of the door 10 may now be further described in view of the figures collectively. In many embodiments, the lock 12 may include features that decouple the handles 42, in other words, rotation of a handle on the interior of the door does not produce rotation of a handle on the outside of the door, and vice versa. These decoupling features may be integral with the lock 12 and are known in the art. The function of the door hardware 14 may therefore be described based on half of the components, either inside or outside of the door 10. In one embodiment, a handle may be assembled to the handle-side recess 58 of the hub 56. As a user turns the handle 42 about rotation axis A, the hub 56 is able to rotate within housing 54. The stopper plate(s) 74 rotate with the hub 56 until the force applied by the user terminates or the stopper plate(s) 74 reach abutment surfaces 70. Further, a spindle 48 may fit in the lock-side recess 102 of the hub 56 and protect into a portion of the lock 12. Therefore, as the hub 56 rotates relative to the housing 54, the spindle 48 may be caused to rotate along with the hub 56, transferring motion into the lock 12 for ultimate retraction of the latch(s) 22. While the hub 56 is rotating relative to the housing 54 under the outside force provided by a user, the spring 80 may be wound tighter, storing potential energy that will bias rotation of the hub 56, handle 42, and spindle 48 in the opposite direction of rotation biased toward the home position after the user removes an outside force.

The structure, function, and use of the handle return cartridges discussed above may translate to several methods of installing door hardware upon a door where the door hardware makes use of the handle return cartridges according to embodiments previously described. Example methods may be described in terms of the following paragraphs:

Paragraph A. A method of installing door hardware on a door, the hardware including an interior escutcheon, an exterior escutcheon, a pair of handles, a left-handed handle return cartridge and a right-handed handle return cartridge, the method comprising:

identifying the proper handle, from the pair of lever-type handles that is appropriate for each escutcheon based on a swinging direction of the door;

identifying the proper handle return cartridge for each escutcheon;

attaching the identified cartridge to the appropriate escutcheon; and installing the door hardware on the door.

Paragraph B. The method of Paragraph A, wherein identifying the proper cartridge comprises:

selecting the left-handed handle return cartridge for the escutcheon whose respective handle lever points left when facing a handle-side of the escutcheon and selecting the right-handed handle return cartridge for the escutcheon whose respective handle lever points right when facing a handle-side of the escutcheon.

Paragraph C. The method of Paragraph A, wherein attaching the identified cartridge comprises screwing a housing onto a lock-side of the appropriate escutcheon.

Paragraph D. The method of Paragraph A, further comprising:

attaching the proper handle lever to each handle return cartridge.

Paragraph E. The method of Paragraph A, wherein installing the door hardware further comprises attaching the escutcheons to the door.

Paragraph F. The method of Paragraph E, wherein attaching the escutcheons comprises:

first position the exterior escutcheon relative to the door;

then positioning the interior escutcheon relative to the door; and then securing the exterior escutcheon to the interior escutcheon with the door therebetween.

The assemblies may also be described in view of the following paragraph:

Paragraph G. A handle return assembly removably attachable to an escutcheon, comprising:

a housing to be attached to the escutcheon;

a hub rotatably disposed within the housing for operably connecting an operating handle to a drive spindle;

a torsion spring biasing the hub toward an initial position; and at least one stopper plate interacting with the housing for limiting rotational motion of the hub relative to the housing, wherein selectively positioning the at least one stopper plate and the spring relative to the housing provides the assembly with an ability to provide a right-handed operation or a left-handed operation.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. A handle return assembly removably attachable to an escutcheon, comprising:

a housing to be attached to the escutcheon;

a hub rotatably disposed within the housing for operably connecting an operating handle to a drive spindle;

a torsion spring biasing the hub toward an initial position; and at least two identical stopper plates operably attached to the hub for rotation therewith, the at least two stopper plates interacting with the housing for limiting rotational motion of the hub relative to the housing, wherein the at least two stopper plates are configured for attachment to the hub in at least three alternative orientations relative to the hub and each other, wherein the at least three orientations correspond respectively with a right-handed operation, a left-handed operation, and a rotationally-fixed operation of the handle return assembly.

2. The assembly of claim 1, wherein the housing comprises protrusions which create a plurality of abutment surfaces for interacting with the at least two stopper plates to limit the direction and degree of rotation between the hub and the housing.

3. The assembly of claim 1, wherein each of the at least two stopper plates comprises a central opening and at least one projection extending from an outer periphery thereof.

4. The assembly of claim 1, wherein positioning the two stopper plates on the hub in opposite orientations substantially prevents rotation of the hub relative to the housing.

5. The assembly of claim 1, wherein each of the at least two stopper plates is 180 degrees rotationally symmetric about at least one axis.

6. The assembly of claim 1, further comprising a retaining ring to maintain the at least two stopper plates around the hub.

7. The assembly of claim 1, further comprising a bushing between the housing and the hub and a push washer between the housing and the spring.

8. A handle return assembly separate from but removably attachable to an escutcheon, wherein the handle return assembly is configured to interact with a handle such that the handle is biased to an initial home position and the handle is rotatable relative to the escutcheon about a predetermined sweep angle in a single direction relative to the home position to define a left-handed operation or a right-handed operation, and wherein the handle return assembly is capable of being disassembled and reassembled using all of the same parts to change the operation of the assembly among the left-handed operation, the right-handed operation, and a non-operating configuration where rotation of the handle in neither direction is permitted, wherein changing the operation comprises reorienting at least one of a pair of stopper plates relative to a hub within the handle return assembly.

9. A door hardware kit comprising:

an exterior escutcheon;

an interior escutcheon;

a first handle return cartridge configured to provide left-handed operation;

a second handle return cartridge configured to provide right-handed operation, wherein each handle return cartridge is capable of being attached to either escutcheon such that the kit is capable of being selectively assembled to operate a left-hand and a right-hand door, wherein each cartridge comprises identical components, the components including:

a housing to be attached to one of the escutcheons;

a hub rotatably disposed within the housing for operably connecting an operating handle to a drive spindle;

a torsion spring biasing the hub toward an initial home position; and a pair of stopper plates disposed around the hub for rotating therewith, interacting with the housing, and limiting a direction and angle of rotational motion of the hub relative to the housing.

10. The kit of claim 9, wherein the exterior escutcheon is unique from the interior escutcheon.

11. The kit of claim 9, further comprising the operating handle, the operating handle being a lever-type handle.

12. The kit of claim 9, further comprising the drive spindle.

13. The kit of claim 9, further comprising an escutcheon gasket.

14. The kit of claim 9, further comprising fasteners for attaching the handle return cartridges to the escutcheons.

15. The kit of claim 9, further comprising a key cylinder.

16. The kit of claim 9, wherein the pair of stopper plates of the first handle return cartridge is provided in a first orientation and wherein the pair of stopper plates of the second handle return cartridge is provided in a second, different orientation.

17. The kit of claim 9, wherein the torsion spring of the first handle return cartridge is provided in a first orientation and wherein the torsion spring of the second handle return cartridge is provided in a second, different orientation.

* * * * *